United States Patent [19]

Phillips

[11] 4,109,686

[45] Aug. 29, 1978

[54] TAX ADJUSTING VEHICLE GASOLINE FILLER EQUIPMENT

[76] Inventor: Jacque R. Phillips, 835 Fountain Ave., Lancaster, Pa. 17601

[21] Appl. No.: 813,350

[22] Filed: Jul. 6, 1977

[51] Int. Cl.[2] ..... B65B 3/04

[52] U.S. Cl. ..... 141/1; 141/94; 141/98; 141/347

[58] Field of Search ..... 141/1, 94, 98, 198, 141/206–229, 232, 311 R, 346, 347, 383–386, 392; 137/234.6; 235/151.34, 61.7 A

[56] References Cited

U.S. PATENT DOCUMENTS

| | | | |
|---|---|---|---|
| 3,650,303 | 3/1972 | Chambers et al. | 141/1 |
| 3,897,810 | 8/1975 | Arnett et al. | 141/346 |
| 3,911,973 | 10/1975 | Casteline | 141/346 X |

*Primary Examiner*—Richard E. Aegerter
*Assistant Examiner*—Frederick R. Schmidt
*Attorney, Agent, or Firm*—John F. McClellan, Sr.

[57] ABSTRACT

A system including means and method for proportioning tax to vehicle efficiency-class at the fuel pump, including: provision of mandatory configuration of each vehicle filler neck in accordance with vehicle efficiency-class, coacting fuel-dispensing pump-nozzle structure to ascertain by the filler neck configuration the efficiency-class vehicle being fueled, and coacting pump structure to tax the quantity dispensed in accordance with the efficiency-class ascertained. In embodiment, a locking system for the fuel nozzle is released only by proper engagement with a receiver according to this invention. Stationary power plants and heating systems can be proportionally taxed as well as automotive air and water vehicles by means of the invention.

6 Claims, 13 Drawing Figures

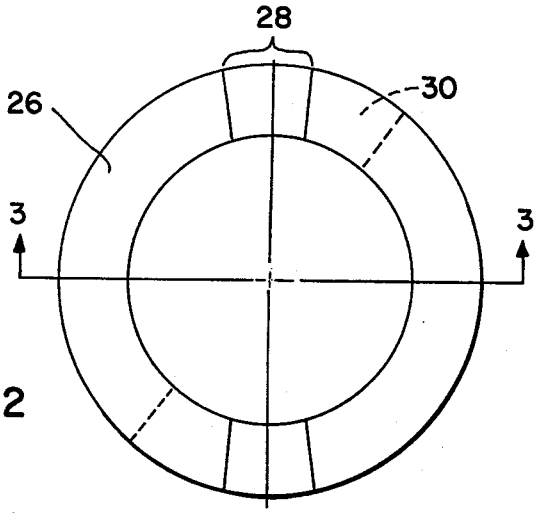
FIG.2
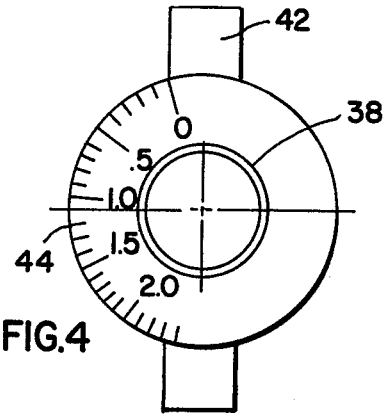
FIG.4
FIG.3
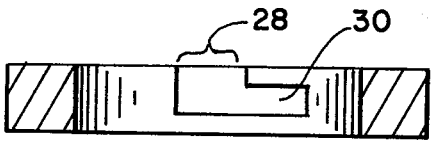
FIG.5
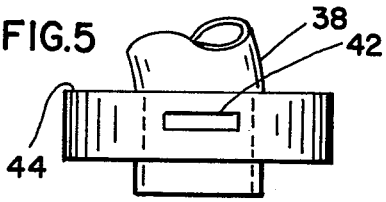
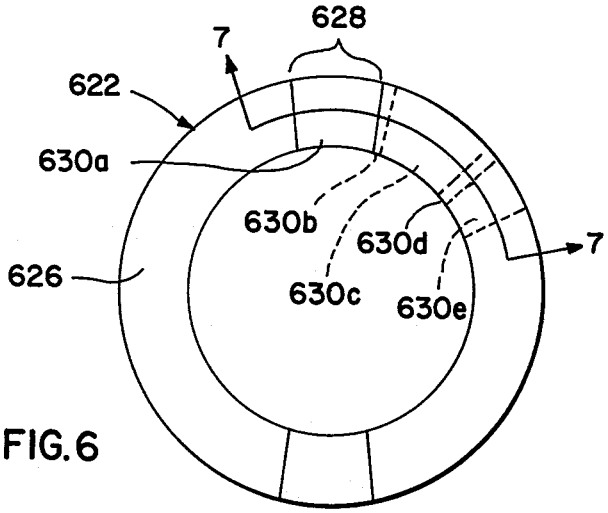
FIG.6
FIG.7
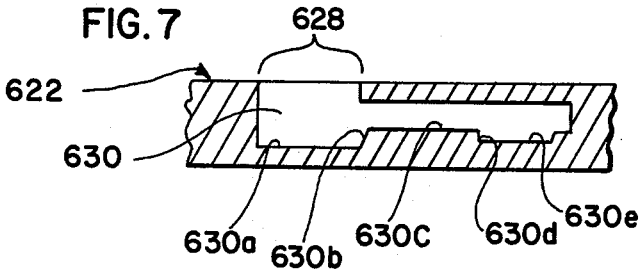

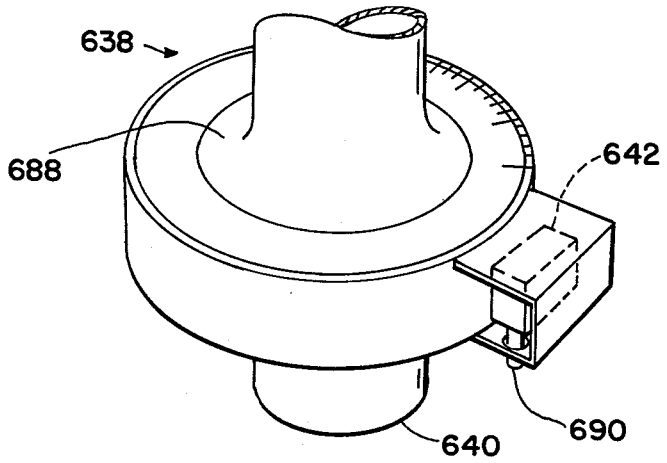
FIG. 8
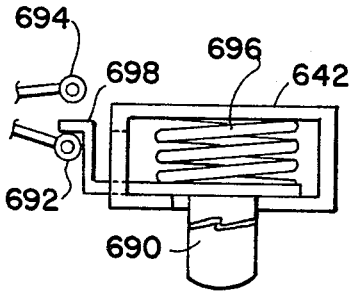
FIG. 9
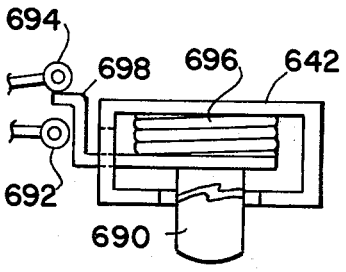
FIG. 10
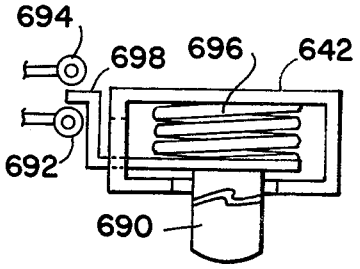
FIG. 11
FIG. 12
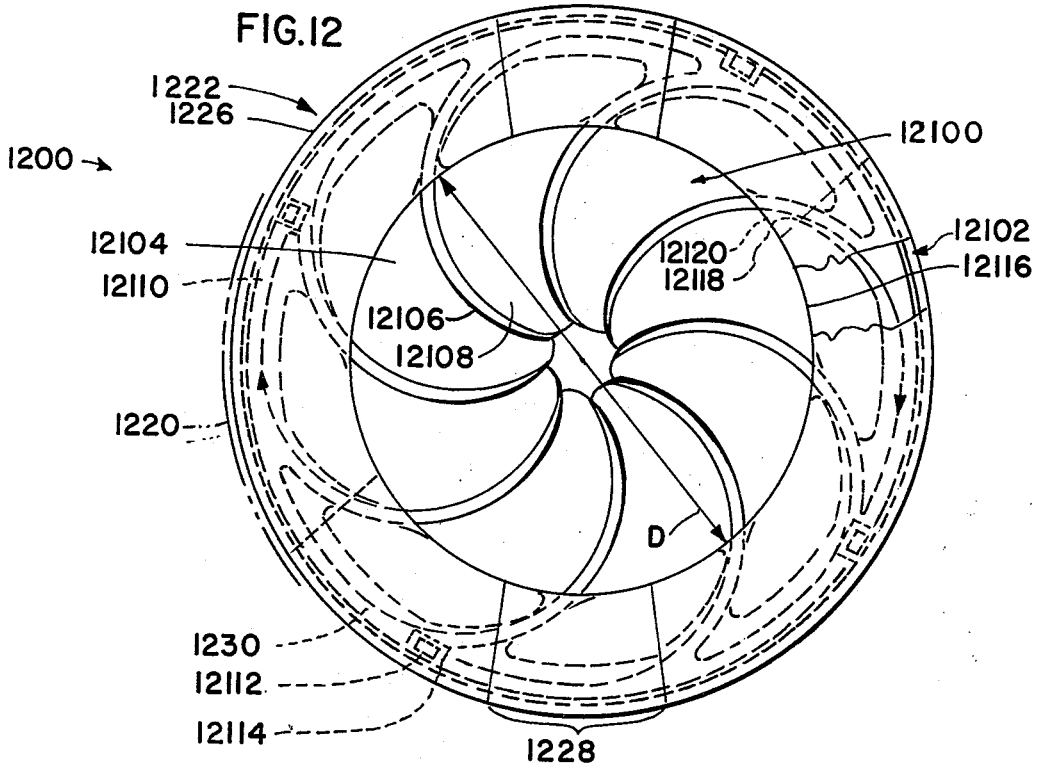

TAX ADJUSTING VEHICLE GASOLINE FILLER EQUIPMENT

This invention relates generally to motor vehicles and specifically to systems for dispensing taxed fuel to motor vehicles.

At the present time fuel conservation is of major concern in this Country. Legislation is being considered to find ways to offer incentives to those who conserve energy and penalize those who do not conserve. Publicly considered are:

1. Tax rebates for purchasers of high MPG rated vehicles;

2. Penalty taxes for purchasers of low MPG rated vehicles, and

3. Escalating gasoline tax should the Nation as a whole not meet consumption reduction targets.

In another field, tax credits are being considered for homes or structures having proper insulation and for homes or structures utilizing solar and other less usual energy.

Although the goals of these proposals are basically the same, to promote the conservation of energy, they are not equitable to all concerned. For example, the penalty tax for low MPG rated vehicles would not be fair to the American automobile makers, nor those who have a need for these larger vehicles. Thus it would lower demand for American type automobiles, reducing production and jobs. An escalating gas tax, should we not meet our nationwide reduction targets, would not be fair to those who are honestly making an effort to conserve, who would ask, "Why should the individual who drives a 40 MPG vehicle be forced to pay the same tax per gallon as one driving an 8 MPG vehicle for the same purpose?"

In the prior art various disclosures are known, exemplified by the following U.S. Pat. Nos.:

3,650,303 to R. E. Chambers et al, 3-21-72, disclosing an identification of the vehicle into which fluid is dispensed, coupled with recording of the details of the transaction;

3,689,749 to R. H. Johnston, 9-5-72, disclosing pricing control- and indicating-equipment;

3,756,630 to J. E. Bickford, 9-4-73, disclosing dispensing-coaction between dispenser and receiver, with associated pricing indicating system;

3,814,148 to W. J. Wostle, 6-4-74, disclosing vehicle identification for dispensing and for pricing indication.

However, none of these disclosures sets out the combination of the present invention and all together fall short of fair suggestion of the novel structure claimed herein and of the operation and results achieved.

This invention has as a principal object to provide method and apparatus for equitable taxation, which penalizes and rewards those who respectively waste fuel and conserve fuel, frequently and in proportion to quantity. A further object of this invention is to provide for easy identification at the fuel pump of the efficiency class of a land vehicle, stationary structure, aircraft, sea craft or other fuel consuming device.

Another object of this invention is to provide a coupling method between fuel dispensing nozzle and receiving tube which exploits the class identification for purposes of adjusting taxes, which prevents the inflow of fuel into the receiving tube unless properly engaged, and which prevents the discharge of fuel from the dispensing nozzle unless properly engaged.

Another object of this invention is to provide a coupling device which can either be incorporated in new dispensing nozzles and receiving tubes or adapted for installation on existing dispensing nozzles and receiving tubes.

Still another object of this invention is to provide a coupling device which is easily adaptable to conventional methods of recording and/or displaying figures.

The invention will be described as relating to automotive vehicles generally but it will be appreciated that the invention pertains to stationary power plants, aircraft, seacraft and other fuel receivers in basically the same manner.

In brief summary given for purposes of cursive description only and not as limitation, the invention includes tamper-resistant fueling system proportioning tax to vehicle efficiency on dispensing.

The above and other objects and advantages of this invention will become more readily apparent on examination of the following description, including the drawings in which:

FIG. 2 is a plan view of a female coupling component;

FIG. 3 is a developed sectional view taken at 3—3, FIG. 2;

FIG. 4 is a plan view of a male coupling component;

FIG. 5 is a side elevational view thereof;

FIG. 6 is a plan view of a female coupling component in a further embodiment;

FIG. 7 is a sectional view taken at 7—7, FIG. 6;

FIG. 8 is an isometric view of a further embodiment male coupling structure showing limit switch enclosure, pintype tab and tab housing;

FIGS. 9, 10 and 11 are diagrammatical sectional views of the pin-type tab respectively in compressed position, engaged position and expanded position.

FIG. 12 is a plan view of still a further embodiment female component; and

FIRST EMBODIMENT

Figure 1:
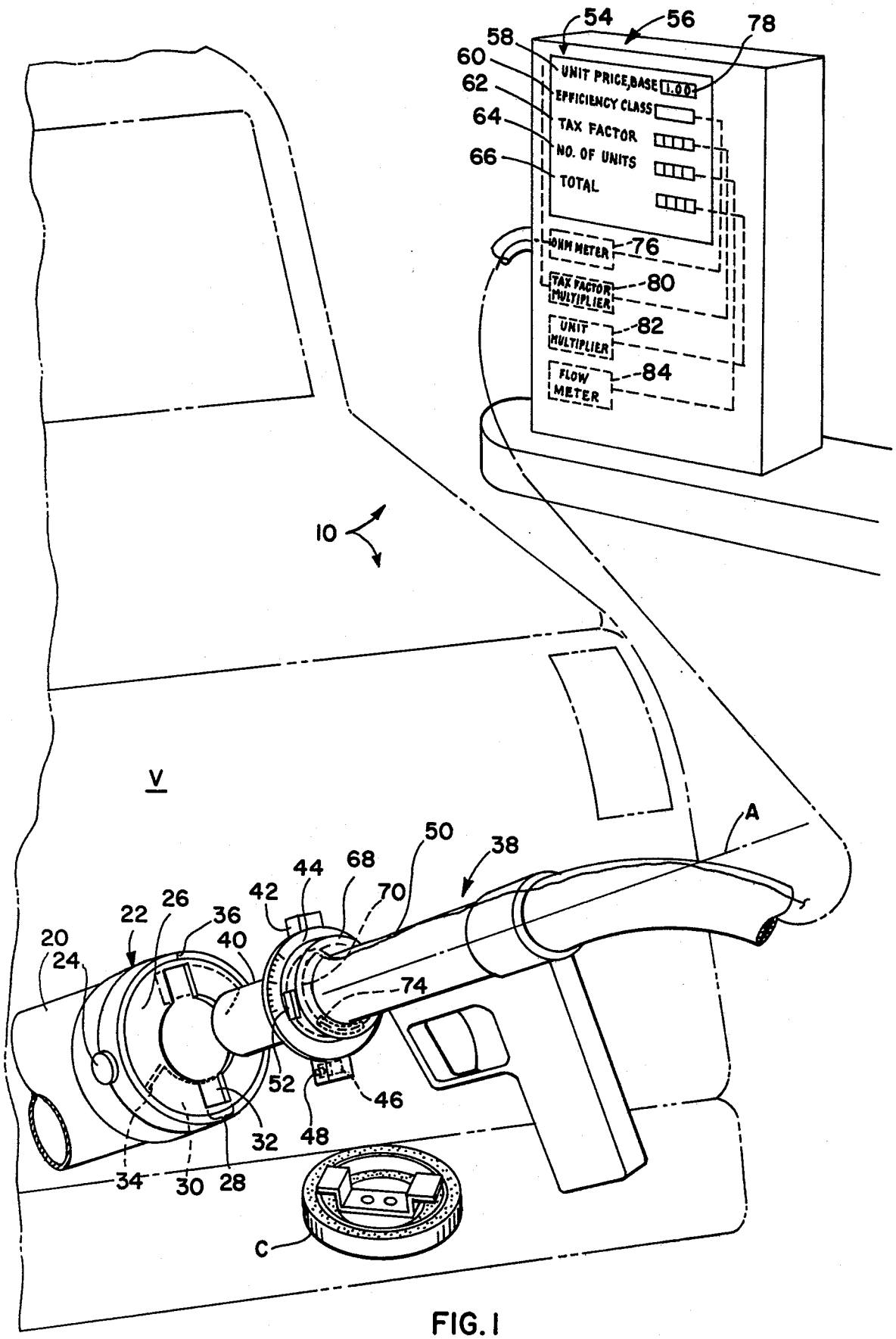
FIG. 1 is a perspective view of vehicle fueling, showing nozzle and filler tube details and a pump display portion of the invention in an embodiment of the invention.

FIG. 1 illustrates in partial detail an embodiment 10 of this invention in operation.

Typical vehicle V has on the fuel receiving tube 20 a special auto filler tube or fuel receiving tube terminus or female connector 22, provided at the factory as original equipment (or it may be provided as an adaptor kit locked in place) preferably having in plain sight a federal seal 24 showing that it has not been tampered with to change the orientation.

Female connector parts provided include in the tube at the end a first annular flange 26 having at least one and preferably two diametrically opposite slots 28. Each slot is the entrance to a circumferential passage or groove 30 lying between the first flange and a second or backup flange 32; arcuate extent or length of the passages is filler tube configuration having a terminus preset as by respective welded blocks or simply by the milled out end 34 of the groove to evidence efficiency of the vehicle (or other receiver). A sturdy pointer 36 integral with the tube is part of scale structure, and marks the top of the tube in alignment with the slot structure. This structure is compatible with filler tube cap C.

Coacting with the female connector parts are special male connector parts on the pump nozzle 38, to limit and to indicate the angle of connection about the long axis with the female parts. These may include about the straight tubular nozzle end part 40 one or more radial lugs 42 for insertion into the slot structure of the female connector when the nozzle is inserted.

After insertion, the nozzle is twisted to the extent possible, passing the lugs against the stops in the ends of the grooves.

The farther the twist, the higher the indicated surtax on the gasoline may be, or, if desired to set the system up to encourage consumers to police the operation visually, the farther the twist the lower the surtax.

Graduated annular collar 44 provides means for observing on an appropriate scale the degree of twist relative to the collar, and calculating the tax on each individual sale of fuel. Even with this structure and no more, service station attendants could accomplish this observation in little more time than required to complete an ordinary charge card transaction. However, as additionally shown in this Figure, automatic structure comprises a part of the preferred embodiment which computes and displays tax due as a function of vehicle efficiency class and quantity dispensed, as follows.

Any conventional tamper-resistant or secure angle-measurement means may be employed for detecting the difference between the rotational angle about long axis A at insertion of the lugs in the slots and the rotational angle when the lugs stop at the ends of the arcuate passages. Conventional means of starting the angle measurement and indicating when the full angle are represented by switch 46 having a bullet-end plunger 48 slightly protrusive laterally from a lug. On insertion in the female connector slot, this switch is depressed and then released in the groove. At the end of travel in rotation it is again depressed. These events indicate through shielded cable 50 the two times the angle values are to be recorded as indicated by a system as described later. A relay system or other suitable conventional means can isolate the reading between these limits according to well known principles; this circuitry is represented by box 52.

Futher, any conventional means may be used to translate this angle into a setting of tax proportioning in a pump computing system so that the entire transaction appears on a pump display panel 54 at pump 56 and is simultaneously recorded internally for tax reporting.

Featured on the display panel and in the recording are entries as follows:

—58, UNIT BASE, which may include price per gallon plus any fixed tax per gallon.

—60, EFFICIENCY CLASS of the vehicle, which may be the Environmental Protection Agency miles-per-gallon rating of the particular vehicle, as reflected by the permitted angle of rotation of the pump nozzle in the vehicle fuel receiver tube.

—62, TAX FACTOR, the surtax added to each unit of fuel in accordance with the efficiency class, as for example, for a 15 mpg vehicle the tax factor might be "2.0", a multiplier applied to a uniform or base tax multiplicand such as $0.25/gallon, yielding $0.50/gallon surtax for a 15 mpg vehicle. Similarly, a 37 mpg vehicle might have a tax factor of "0.5", yielding a surtax per gallon of $0.125.

—64, NUMBER OF UNITS would be the number of gallons dispensed.

—66, TOTAL would set out the dollar amount due from the purchaser.

One conventional mechanism for accomplishing this sensing, indication and computation is indicated for angled-fuel-tube type vehicles like that shown.

Toroidal meniscus tube 68 fixed concentrically on the straight pump nozzle has around it an internal non-linear resistance loop 70 connecting it at the ends to the twin-conductor shielded cable 50. A body of mercury 74 or other free-flowing self-cohesive conductive fluid, fills a portion of the length of the meniscus tube, shorting out a fixed length of the nonlinear resistance loop. Resistance of the loop is thus a function of orientation about nozzle axis A, and by means of the shielded cable affixed along the hose the resistance value is carried to a conventional resistance bridge 76 or other ohm-meter. The analog numerical value is displayed as efficiency-class by conventional means which may include digital readout by light emitting diodes at 78, and also is transmitted to the tax factor multiplication stage 80. Similarly, the appropriate proportional tax factor set into the unit is displayed opposite that entry and transmitted for multiplication. Unit multiplication stage 82 multiplies the number of units indicated by the flowmeter 84 and displayed opposite the number of units entry. The product of the unit multiplication stage which includes in the calculation all the above parameters, is displayed opposite the total entry. Appropriate leads connect the various elements as indicated.

FIGS. 2 and 3 detail the female flange structure on the vehicle fueling tube.

Annulus 26 can be of one piece, with the slots 28 and the groove 30 from the slots milled out or otherwise fabricated by conventional means, the unit is preferably of very hard steel such as tempered tool steel.

FIGS. 4 and 5 detail the graduated circular scale or annular collar 44 and lugs 42 on the nozzle 38 as forming an integral whole, which can be assembled by welding if desired.

SECOND EMBODIMENT STRUCTURE

FIGS. 6 and 7 diagram further provisions, which may be embodied in the invention, flange apparatus assuring that the female and male connector structure is fully coupled before fuel can flow. This restraint prevents accidental failure to rotate the pump nozzle fully, for a given filler tube structure. In this arrangement, female flange element 622 has the slot or slots 628 the same, but the groove is depth-contoured as a cam, as follows: Measured axially inward in depth, the groove region 630 a immediately below the slot is deepest, and connects by an upward ramp 630 *b* with a table area 630 *c* of relatively shallow depth, followed down a second ramp 630 *d*, by a region of intermediate depth 630 *e* at the groove end.

In operation, as will be seen, in this embodiment an axially movable pump switch-controlling pin in the male connector integral with the pump nozzle acts as a cam follower, following the groove depth to delay fluid delivery by disabling the nozzle (or alternatively by any other conventional means such as switching off the pump) until the pin falls into the last or intermediate-depth groove portion, assuring full rotation of the nozzle to prevent improper taxation of transactions.

Disabling the nozzle can be by conventional means not shown, such as by ordinary fluid-flow vacuum holding of a piston which releases when the vacuum is broken on filling to an operation intake opening level on the nozzle side.

FIG. 8 diagrams general structural relation of the alternative nozzle 638 as it pertains to this embodiment.

Housing 688 encloses limit switches shown later, which are controlled by the axial position of pin-type tab or camfollower plunger 690, which preferably has a rounded free-end, and which itself is housed in slot-and-groove-engaging lug 642.

FIGS. 9, 10 and 11 diagram the positions of the cam-follower plunger 690 during a rotational half-cycle coupling with the female connector, and corresponding positions of the limit switches 692, 694 controlled by it.

FIG. 9 shows that before and during insertion of the nozzle, spring 696 drives the cam follower plunger down, the location of the deepest recess of the cam allowing it to remain down when inserted, and the cam follower lateral extension 698 depresses lower switch arm 692 preventing fuel flow.

FIG. 10 shows that when turned part way, the nozzle carries the cam follower plunger to an up or retracted position on table area of the cam bottom contour, and the resulting upward position of the cam follower lateral extension raises the upper switch arm 694 and similarly prevents fuel delivery.

FIG. 11 shows that only when the cam follower plunger rests at the intermediate level provided by cam recess at the end of the groove does the cam follower extension lie between switch arms in a neutral position, permitting fuel to flow and assuring accurate taxation.

THIRD EMBODIMENT STRUCTURE

In an embodiment 1200 diagrammed in the next, and final, two Figures, a special twist-operated diaphragm of novel construction substantially restrains flow into the vehicle fuel filler or receiving tube in which it is installed below the annular flange, until a pump nozzle is connected by the lugs as above described with the female flange structure and is properly rotated to the correct tax charging position, retracting the diaphragm blades by rotating about the nozzle axis a continuous outer ring of the diaphragm with which the diaphragm blades connect, retracting the diaphragm blades outwardly.

A short nozzle is used so that it will not touch the diaphragm.

FIG. 12 shows that the female annular flange structure 1226 containing the slots 1228 and grooves 1230 is generally like that described for the first embodiment and functions for the same purpose, to designate by the circumferential length of the groove the efficiency-class of the vehicle of which it is an integral part.

Flexible diaphragm structure 12100 is contained at the perimeter in an annular 12102 also within a part of the filler tube 1220 and located below the annular flange structure 1226. The flexible diaphragm structure is shown in nearly closed position. Each blade 12104 has a spine or ridge 12106 curved in plan view, and integrally along it on the concave side a correspondingly curved lobe 12108 twisted like a propeller blade and overlapping the underside of the next blade. For expositional purposes a small hole is shown in the center; this may be nearly closed. When the blades retract radially as the ring 12110, located peripherally around the blades and integral with them, rotates in the direction of the curved arrows impelled by the lugs of the nozzle acting through push bars 12112 engaging notches 12114 in the ring, this hole expands approximately to the size of the central circular aperture in the annular flange, represented by the diametral arrow D spanning the inner wall 12116 of the annular flange.

Incline from the vertical of the respective guides 12118 forming apertures 12120 leading through the inner wall of the annular flange twists the blades into aspect more parallel with the axis of the filler tube as they retract, permitting greater fluid flow past any tip protrusions.

Figure 13:
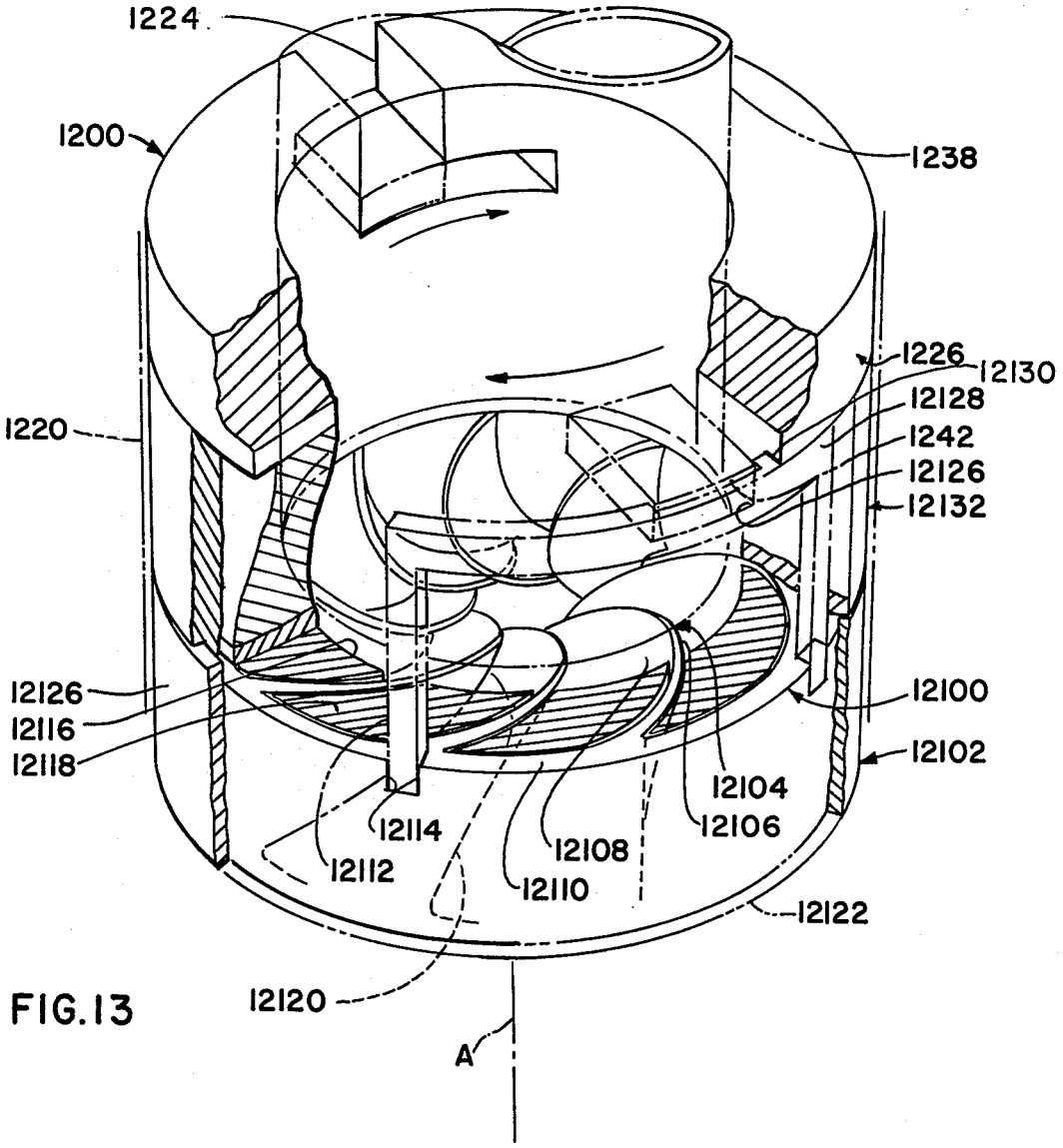
FIG. 13 is an isometric view in partial section.

FIG. 13 shows that the hollow annular housing 12102 has preferably the same outside and inside diameters as the female flange structure 1226. Both are as noted contained in the filler tube 1220 at the outside diameter as by welding.

An annular bottom 12122 connects the annular housing outer wall 12126 with the concentric inner wall 12116 having the faired arcuate guide structure 12118 forming the uniformly circumferentially spaced plurality of apertures 12120 canted with the axis A and passing the respective propeller-shaped lobes 12108 of the diaphragm through to integral junction with the ring 12110 in the annular space adjacent the housing outer wall 12126.

Actuation of the diaphragm to retract the lobes and let fuel pass is as noted by means of the lugs 1242 of the pump nozzle 1238, all shown in phantom lines. When the lugs are inserted in the slots 1224 in the annular flange 1226 they engage respective notches 12126 in arcuate members 12128 slidably contained in respective circumferential recesses 12130 in the outer wall of a cylindrical member 12132 spacing the annular flange 1226 from the annular housing 12102. Push bars 12112 extend downward from each arcuate member end, and each push bar engages a notch 12114 in the diaphragm ring 12110. So, when the lugs are turned by turning the nozzle upon insertion above the diaphragm, for dispensing fuel, the diaphragm ring 12110 rotates retracting the flexible blades 12104 by drawing them outwardly. Similarly, when the nozzle is counter-rotated to release the lugs and withdraw the nozzle, the ring is counter-rotated and the resilient lobes again protrude inwardly in flat, contiguous, overlapping array, substantially closing the bore of the annular housing and thus of the filler tube.

Material for the diaphragm may be a suitable grade of polypropylene or any other suitably elastic fuel resistant thermoplastic with a wide temperature range of elasticity.

In the foregoing discussion, miles per gallon and gasoline, have generally been referred to, but it will be appreciated that liters of diesel oil, cubic feet of propane gas or other fuels and units of measurement may fall equally within the scope of this invention.

This invention is not to be construed as limited to the particular forms disclosed herein, since these are to be regarded as illustrative rather than restrictive. It is, therefore, to be understood that the invention may be practiced within the scope of the claims otherwise than as specifically described.

What is claimed and desired to be secured by United States letters patent is:

1. The method of apportioning surtax in dispensing fuel through a nozzle rotatably associatable with a filler tube in a fuel receiver in accordance with the fuel efficiency classification of the receiver, consisting of the steps:

(a) constraining rotatability of the nozzle with respect to the filler tube to a limit evidencing fuel efficiency classification of the receiver;

(b) requiring rotation of the nozzle to said limit when associated with the filler tube prior to fuel dispensing; and (c) indicating the degree of rotation of the nozzle, as a measure of surtax apportionable; thereby apportioning surtax in accordance with fuel efficiency classification of the receiver.

2. In a system for fuel dispensing having nozzle with a lug fixed thereon, a filler tube proportioned for receiving the nozzle rotatably therein and having an axial slot and a groove circumferentially extending from the axial slot proportioned for receiving the lug for locking together the nozzle and filler tube by means of lug rotation around the groove upon said relative rotation between nozzle and filler tube; a source of fuel having fuel dispensing connection with the nozzle, means for conveying data about fuel dispensing, and a receiver of a particular fuel efficiency classification having fueling connection through the filler tube, the improvement comprising: the data conveying means including means terminating the groove at a distance from the slot proportional to fuel efficiency classification of the receiver, and means displaying said distance the lug is rotated to the terminating means as a measure of receiver fuel efficiency classification.

3. In a system as recited in claim 2, means permitting dispensing of fuel through the nozzle only when the lug is rotated in the groove said distance to the terminating means.

4. In a system as recited in claim 3, the means displaying giving visual indication at said locking together of the nozzle and filler tube and comprising: a first scale element on the filler tube in predetermined relation to the slot, and a second scale element on the nozzle in predetermined relation to the lug and located for positional coaction indicative of degree of rotation relative to the first scale element.

5. In a system as recited in claim 3, the means displaying including: means on the nozzle for sensing said distance the lug is rotated to the terminating means, means at the source for remotely indicating said distance sensed, and means responsively connecting the means on the nozzle with said means at the source.

6. In a system as recited in claim 3, the means permitting dispensing of fuel through the nozzle only when the lug is rotated said distance to the terminating means comprising: the source including means for supplying fuel upon electrical actuation, and the improvement further comprising means at the receiver for electrically actuating the means for supplying, when the lug is rotated said distance to the terminating means.

* * * * *